US008476511B1

(12) United States Patent
Stenuf

(10) Patent No.: US 8,476,511 B1
(45) Date of Patent: Jul. 2, 2013

(54) DEVICE AND METHOD TO SECURE A PIANO FALLBOARD

(76) Inventor: Marlene Stenuf, Skaneateles, NY (US)

( * ) Notice: Subject to any disclaimer, the term of this patent is extended or adjusted under 35 U.S.C. 154(b) by 0 days.

(21) Appl. No.: 13/353,789

(22) Filed: Jan. 19, 2012

(51) Int. Cl.
*G10C 3/02* (2006.01)

(52) U.S. Cl.
USPC ..... 84/179

(58) Field of Classification Search
USPC ..... 84/179
See application file for complete search history.

(56) References Cited

U.S. PATENT DOCUMENTS

| | | | | |
|---|---|---|---|---|
| 802,757 | A * | 10/1905 | Hermanson | 84/179 |
| 879,739 | A | 2/1908 | Clark | |
| 924,247 | A * | 6/1909 | Lang | 84/179 |
| 998,178 | A * | 7/1911 | Hosley | 84/179 |
| 1,077,732 | A * | 11/1913 | Mehlin | 84/179 |
| 1,085,927 | A * | 2/1914 | Mehlin | 84/179 |
| RE21,614 | E * | 11/1940 | Day | 84/179 |
| 4,667,557 | A * | 5/1987 | Nichols | 84/179 |
| 5,918,296 | A * | 6/1999 | Ishida et al. | 84/179 |
| 5,942,702 | A * | 8/1999 | Inoue | 84/179 |
| 6,130,371 | A * | 10/2000 | Inoue | 84/179 |
| 6,545,203 | B2 * | 4/2003 | Arimori | 84/179 |
| 6,673,991 | B2 | 1/2004 | Hara | |
| 7,012,179 | B2 * | 3/2006 | Shimano | 84/179 |
| 7,550,658 | B2 * | 6/2009 | Suzuki et al. | 84/179 |
| 7,589,265 | B2 * | 9/2009 | Kenagy et al. | 84/177 |
| 2002/0139236 | A1 * | 10/2002 | Sandifer | 84/179 |

FOREIGN PATENT DOCUMENTS

JP 09062252 A * 3/1997

* cited by examiner

*Primary Examiner* — David Warren
*Assistant Examiner* — Robert W Horn
(74) *Attorney, Agent, or Firm* — Harris Beach PLLC

(57) ABSTRACT

A system and method to secure a piano fallboard is provided. In one embodiment, a method of retaining the piano fallboard in the upright position includes securing the fallboard to the back panel with a fallboard retaining device. In another embodiment, a method of retaining the piano fallboard in the closed position includes securing the fallboard to the keyslip with the fallboard retaining device. The fallboard retaining device can be a clamping structure or a magnetic device.

27 Claims, 5 Drawing Sheets

DEVICE AND METHOD TO SECURE A PIANO FALLBOARD

FIELD OF THE INVENTION

This disclosure relates generally to pianos and, more specifically, to a device and method that retains a piano fallboard in an upright position or in a down and locked position.

BACKGROUND OF THE INVENTION

Most keyboard musical instruments are provided with a fallboard which may be closed to conceal the keyboard when the instrument is not being used. When the fallboard is closed, the keyboard is protected from the long term effects of dust and other airborne pollutants and even light which can cause the white keys to yellow over a period of years. Conventionally, a piano fallboard has a rear portion hinged to a support. The fallboard is rotated about a hinge for opening and closing. To close the fallboard, it is pulled forward and rotated until the bottom of a front end contacts or rests on the top of a keyslip.

One drawback to this manner of closing and opening the fallboard is that if the closing operation is not properly carried out, or if the piano user accidentally bumps the upright fallboard while playing, the fallboard is free to rotate in a downward direction and, due to its weight, may slam down against the keyslip. The rapid drop can cause damage to the keyslip or, worse, injure the user if their fingers are caught between the fallboard and the keyslip.

SUMMARY OF THE INVENTION

In accordance with one aspect of the disclosure, a fallboard retainer system for a piano is provided. The fallboard retainer system includes a piano housing, a vertical back panel secured to the piano housing, opposing cheeks extending from and secured to the piano housing, a keyboard positioned in a horizontal plane between the opposing cheeks, and a keyslip extending between the opposing cheeks along a frontal portion of the keyboard. The fallboard retainer system further includes a fallboard to protect the keyboard when the piano is not in use. The fallboard is positioned between the opposing cheeks and rotatably coupled to the piano housing, and is rotatable to an open state in an upright position and rotatable to a closed state in a horizontal position. The fallboard supported by the keyslip in the closed state and the vertical back panel in the open state. The fallboard retainer system further includes a fallboard retaining device for retaining the fallboard in the upright position. The retaining device has a first leg normal to the plane of the keyboard, a second leg in spaced apart relationship with and substantially parallel to the first leg, and a spanner segment parallel to the plane of the keyboard joining the first leg and the second leg. The first leg has a first contact surface for abutment with a stationary surface of the piano, and the second leg has a second contact surface for abutment with a movable surface of the fallboard.

In one embodiment, the first contact surface abuts the back panel, and is in opposing relation to the second contact surface.

In another embodiment, the second leg is adjustable with respect to the first leg.

In yet another embodiment, the first contact surface abuts the one of the opposing cheeks.

In another aspect of the disclosure, a fallboard retaining device for retaining a piano fallboard in the upright position includes a first leg having a first contact surface for abutment with a piano back panel, and a second leg in spaced apart relationship with and substantially parallel to the first leg. The second leg has a second contact surface opposing the first contact surface for abutment with the fallboard. The fallboard retaining device further includes a spanner segment parallel to the plane of the keyboard joining the first leg and the second leg. The spanner segment is adapted to separate the first contact surface and the second contact surface by a distance D sufficient to permit the first leg and the second leg to capture and retain the back panel and the fallboard.

In yet another aspect of the disclosure, a method of retaining a piano fallboard in the upright position is provided. The method includes the steps of providing a piano comprising a vertical back panel, a keyboard, a keyslip supporting the keyboard, and a fallboard to protect the keyboard when the piano is not in use. The method further includes the step of securing the fallboard to the back panel with a fallboard retaining device when the fallboard is in an upright position. The fallboard retaining device is coupled to either a planar section of the fallboard or a lip of the fallboard.

In one embodiment, the fallboard retaining device is coupled to the planar section of the fallboard and includes a first permanent magnet and a ferromagnetic material. The method of retaining a piano fallboard in the upright position includes the step of releasably securing the fallboard to the back panel by lifting the fallboard within close proximity to the back panel such that a magnetic field of the first permanent magnet attracts and holds the ferromagnetic material.

In another embodiment, the method further includes the step of securing the fallboard to the keyslip when the fallboard is in a closed position by embedding a second ferromagnetic material into the keyslip and, with the ferromagnetic material embedded into the fallboard, lowering the fallboard within close proximity to the keyslip such that a magnetic field of the permanent magnet attracts and holds the second ferromagnetic material.

In yet another aspect of the disclosure, a fallboard retainer system for a piano is provided that includes a piano housing, opposing cheeks extending from and secured to the piano housing, a keyboard positioned in a horizontal plane between the opposing cheeks, a keyslip extending between the opposing cheeks along a frontal portion of the keyboard, and a vertical back panel secured to the piano housing. The back panel has a ferromagnetic plug coupled to it. The fallboard retainer system further includes a fallboard to protect the keyboard when the piano is not in use. The fallboard is positioned between the opposing cheeks and is rotatably coupled to the piano housing. The fallboard is rotatable to an open state in an upright position and rotatable to a closed state in a horizontal position. The fallboard is supported by the keyslip in the closed state and the vertical back panel in the open state. The fallboard retainer system further includes a fallboard retaining device for retaining the fallboard in the upright position. The retaining device includes a permanent magnet coupled to the fallboard. The magnet is movable to a first position in which a magnetic field of the magnet attracts the ferromagnetic plug and holds the fallboard against the back panel. The magnet is further movable to a second position in which the magnetic field of the magnet does not attract the ferromagnetic plug and the fallboard is allowed to freely separate from the back panel.

In one embodiment, the first position is rotated 90 degrees from the second position.

In another embodiment, the fallboard retainer system includes a plurality of permanent magnets coupled to the fallboard.

In another embodiment, the fallboard retainer system further includes a second ferromagnetic plug coupled to the keyslip, and the permanent magnet and the second ferromagnetic plug couple to form a keyboard lock. The first position of the permanent magnet aligns the magnetic field of the permanent magnet to attract the second ferromagnetic plug and secure the fallboard against the keyslip. In the second position, the magnetic field of the magnet does not attract the second ferromagnetic plug and the fallboard is allowed to freely separate from the keyslip.

In yet another embodiment, the fallboard retainer system further includes a detached device adapted to alter the magnetic field of the permanent magnet.

In one example, the detached device is a fob.

In another example, the detached device is a key.

In yet another example, the magnetic field of the permanent magnet is altered by rotating the magnet.

In another aspect of the disclosure, a fallboard retainer system for a piano is provided that includes a piano housing, opposing cheeks extending from and secured to the piano housing, a keyboard positioned in a horizontal plane between the opposing cheeks, a keyslip extending between the opposing cheeks along a frontal portion of the keyboard, and a fallboard to protect the keyboard when the piano is not in use. The fallboard is positioned between the opposing cheeks and is rotatably coupled to the piano housing. The fallboard is rotatable to an open state in an upright position and rotatable to a closed state in a horizontal position. The fallboard is supported by the keyslip in the closed state. The keyslip includes a ferromagnetic plug coupled thereto. The fallboard retainer system further includes a fallboard retaining device for retaining the fallboard in the closed state in the horizontal position. The retaining device includes a permanent magnet coupled to the fallboard. The magnet is movable to a first position in which a magnetic field of the magnet attracts the ferromagnetic plug and holds the fallboard against the keyslip, and movable to a second position in which in which the magnetic field of the magnet does not attract the ferromagnetic plug and the fallboard is allowed to freely separate from the keyslip.

BRIEF DESCRIPTION OF THE DRAWINGS

The features described herein can be better understood with reference to the drawings described below. The drawings are not necessarily to scale, emphasis instead generally being placed upon illustrating the principles of the invention. In the drawings, like numerals are used to indicate like parts throughout the various views.

DETAILED DESCRIPTION OF THE INVENTION

The illustrated embodiments of the invention presented herein are commonly found on a grand piano. However, the claimed invention is not limited to a grand piano, and is applicable to other keyboard-related instruments including an upright piano.

Figure 1:
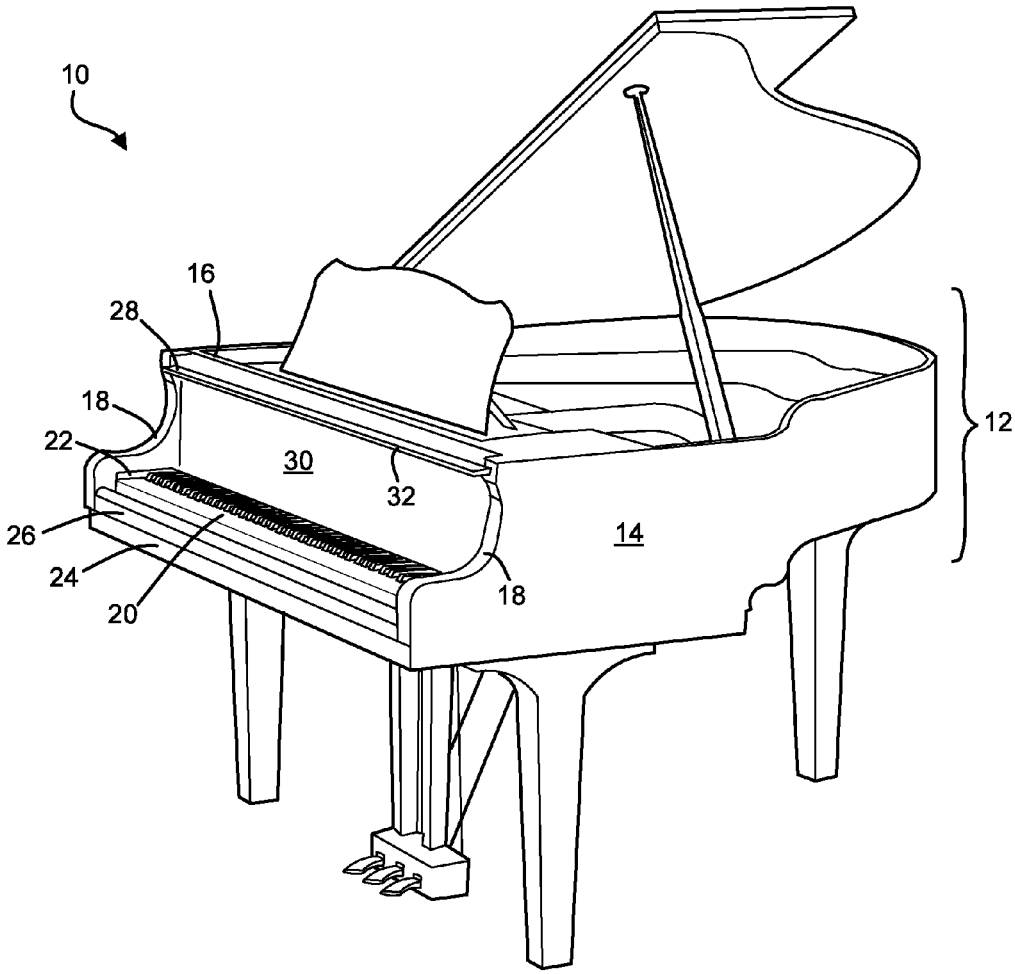
FIG. 1 is a perspective view of a piano.

Referring to FIG. 1, a fallboard retainer system 10 for a piano includes a piano housing 12, which may be the piano case or wooden cabinet that houses the strung back and playing mechanism of the piano. The housing 12 includes a rim section 14 resembling a harpsichord. The rim includes a spine, bentside, and tail. The spine is a long straight portion that is on the bass side of the piano, the bentside is the curved portion that is on the treble side of the piano, and the tail is that portion of the rim opposite the keyboard. On modern grand pianos, the tail is curved to match the bentside. The housing 12 further includes a vertical back panel 16 positioned between the spine and backside to complete the rim structure.

Extending forward from the spine and the bentside of the rim section 14 are opposing cheeks 18. The cheeks 18, typically blocks of curved wood about the same width as the rim section 14, serve to laterally position a keyboard 20, that is, prevent side-to-side movement of the keyboard. In some piano constructions, a removable keyblock 22 may be positioned between the cheek 18 and the keyboard 20 to provide a simpler form of lateral adjustment for the keyboard. The cheeks 18 and rim section 14 are supported from underneath by a case support 24.

The keyboard 20 includes the 88 keys of the piano and a keyframe (not shown) upon which the keys are mounted. The keyframe is a wooden frame that is fitted with a collection of rails and guides that support the keyboard and the action mechanism, which translates the depression of the keys into rapid motion of a hammer, which in turn creates sound by striking the strings. The keyframe rests on a keybed, which is part of the piano housing 12. A keyslip 26 extends across the front of the piano housing 12 between the cheeks 18 and hides the keyframe from sight.

The fallboard retainer system 10 further includes a fallboard 28 to protect the keyboard when the piano is not in use. Also referred to as a keyboard cover or keylid, in one construction the fallboard 28 has a long, planar section 30 adapted to extend over the keyboard 20 and a lip 32 perpendicular to the planar section. The fallboard 28 is conventionally hinged at a rear portion thereof to a portion of the piano housing 12. The hinge permits the fallboard 28 to be rotated to an open state in an upright position (as shown in FIG. 1), and rotated to a closed state in a horizontal position (not shown). In the upright position, the fallboard 28 rests backwards (e.g., past top dead center) against the back panel 16. To close the fallboard 28 from the upright position, it is pulled forward and rotated downward until the lip 32 contacts or rests on the top of the keyslip 26. The height of the lip 32 assures the planar section 30 will not contact the keyboard 20 when in the closed position.

As noted above, the heavy weight of the fallboard 28 renders it prone to accidental dropping. A user's fingers may slip from the lip 32 when closing (or raising) the fallboard 28, or the fallboard may be bumped when the user is playing the piano. Therefore, what is needed is a device to keep the fallboard 28 in the upright position while the piano is being played.

Figure 2:
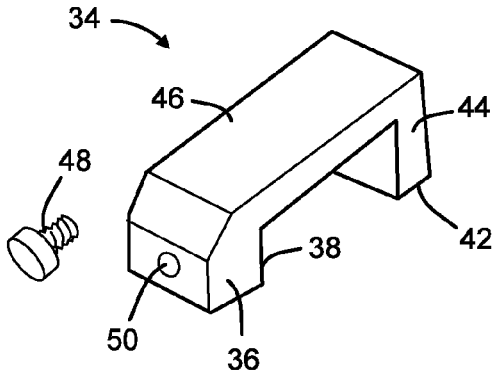
FIG. 2 is an exploded perspective view of a fallboard retaining device in accordance with one embodiment of the present invention.
Figure 3:
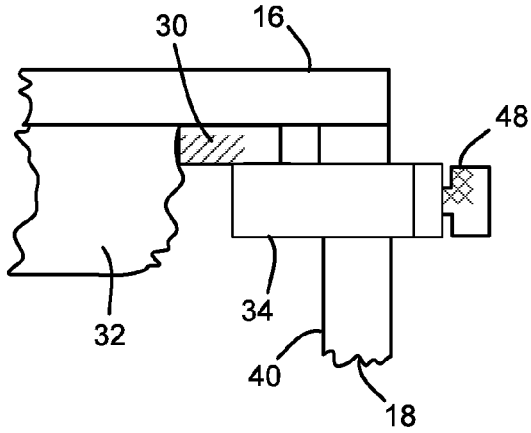
FIG. 3 is a top schematic view of the fallboard retaining device of FIG. 2 installed on the piano shown in FIG. 1.
Figure 4:
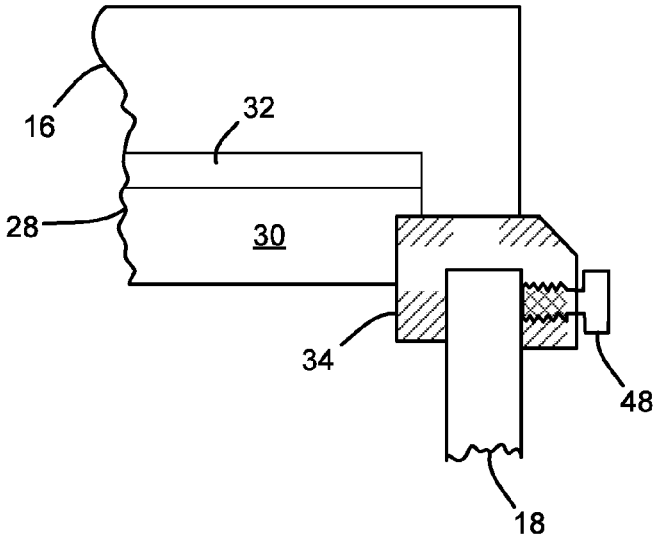
FIG. 4 is a front schematic view of the fallboard retaining device of FIG. 2 installed on the piano shown in FIG. 1.

Referring to FIGS. 2-4, a fallboard retaining device 34 is provided that addresses this need. In the disclosed embodiment, the fallboard retaining device 34 fits over the width of the cheek 18 towards the top thereof, on the vertical portion of the cheek, just under the lip 32 of the fallboard 28. The fallboard retaining device 34 includes a first leg 36 that is normal, or perpendicular, to the horizontal plane of the keyboard 20. The first leg 36 has a first contact surface 38 that abuts with a side surface 40 of the cheek 18. The fallboard retaining device 34 further includes a second leg 42 spaced apart from and substantially parallel to the first leg 36. The second leg 42 has a second contact surface 44 adapted to abut a movable surface of the fallboard 28. In the illustrated example, the movable surface is the planar section 30 underneath the lip 32. The first leg 36 and second leg 42 are joined by a spanner segment 46 that is parallel to the plane of the keyboard 20. In this manner, the fallboard retaining device 34 forms a C-shape.

The spanner segment 46 is configured to separate the first leg 36 and the second leg 42 by a distance sufficient to permit the fallboard retaining device 34 to fit over the width of the cheek 18. In some applications, it may be desirable to firmly secure the fallboard retaining device 34 in place. For example, the retaining device 34 may be placed over the cheek 18 and pushed up against the planar section 30 of the fallboard 28. As there may be a little play in the fit, because the spacing between the legs 36, 42 is slightly greater than the width of the cheek 18, a securement element 48 may be utilized to fasten the fallboard retaining device 34 to the cheek 18. In one embodiment, the fallboard retaining device 34 further includes a threaded bore 50 through the first leg 36, and a bolt 48 is used in the threaded bore to draw the second leg 42 into the cheek 18. In an alternate construction, the threaded bore 50 and bolt 48 are fastened to the second leg 42.

In another embodiment of the present invention, shown in FIG. 4, the fallboard retaining device 34 is positioned over the width of the cheek 18 as described above, except on the horizontal portion of the cheek. In this manner, the fallboard 28 is prevented from fully closing and thus would spare a user's fingers from being crushed in the event of the fallboard dropping.

Figure 5:
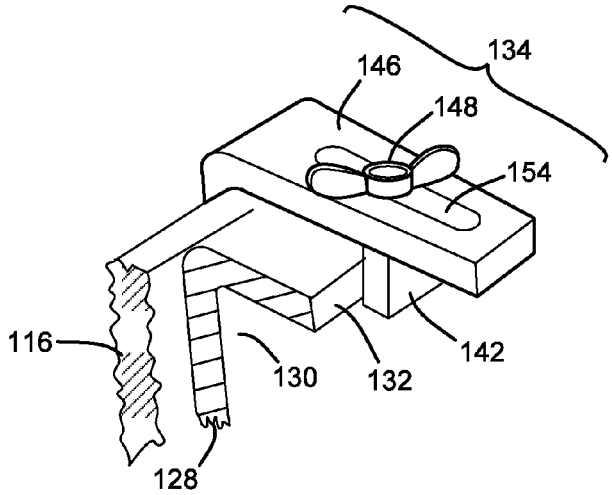
FIG. 5 is a perspective view of a fallboard retaining device in accordance with another embodiment of the present invention, shown installed on the piano shown in FIG. 1.
Figure 6:
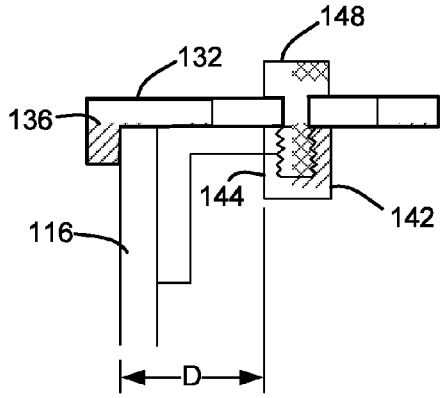
FIG. 6 is a side schematic view of the fallboard retaining device of FIG. 5.
Figure 7:
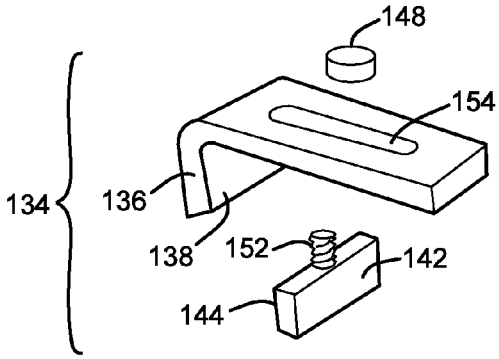
FIG. 7 is an exploded perspective view of the fallboard retaining device of FIG. 5.

Referring to FIGS. 5-7, in another embodiment of the invention, a fallboard retaining device 134 is adapted to fit over a back panel 116 of the piano in order to retain a fallboard 128 in an upright position. As described above with reference to FIGS. 2-3, the fallboard 128 includes a long planar section 130 extending over the keyboard 120 and a lip 132 perpendicular to the planar section. The retaining device 134 includes a first leg 136 that is normal, or perpendicular, to the horizontal plane of a keyboard 120, a second leg 142 parallel to the first leg, and a spanner segment 146 joining the first leg and the second leg. The first leg 136 includes a first contact surface 138 that abuts a rear surface of the back panel 116. The second leg 142 includes a second contact surface 144 adapted to abut a movable surface of a piano fallboard 128. In the disclosed embodiment, the movable surface of the fallboard 128 is the lip 132. The second contact surface 144 is positioned to oppose the first contact surface 138, and the spanner segment 146 separates the first contact surface and the second contact surface by a distance D sufficient to permit the first leg and the second leg to capture and retain the back panel 116 and the fallboard 128 together.

In one example, the distance D is dimensioned to provide a slightly loose or slip fit, so the fallboard retaining device 134 may be simply placed over the top of the back panel 116 and the fallboard 128.

Not all piano back panels and fallboards share the same dimensions. Therefore, a class of sizes that could be adapted to fit over a range of back panels and fallboards may provide an adequate solution. However, an alternate solution is to provide an adjustable fallboard retaining device 134 as shown in FIGS. 5-7. The retaining device 134 includes a separate second leg 142 that is adjustable with respect to the integral first leg 136 and spanner segment 146. The second leg 142 includes a post 152 extending through an elongated slot 154 in the spanner segment 146, and a securement element 148 is removably coupled to the post. In one example, the post 152 is threaded, and the securement element 148 is a wing nut.

To fasten the fallboard retainer system 110 to the piano and retain the fallboard 128 in the upright position, the second leg 142 is disassembled from the spanner segment 146. The first leg 136 is held in place against the back panel 116, and the post 152 on the second leg 142 is pushed up through the slot 154 in the spanner segment 146. The second leg 142 is then pushed firmly against the lip 132 of the fallboard 128, and the wing nut 148 tightened by hand.

In one example, the fallboard retainer system is formed of a stiff yet resilient material such as foam. In another example, the retainer system is formed of wood and stained, so as to match the piano. In other examples, the retainer system is formed of plastic or metal.

Figure 8B:
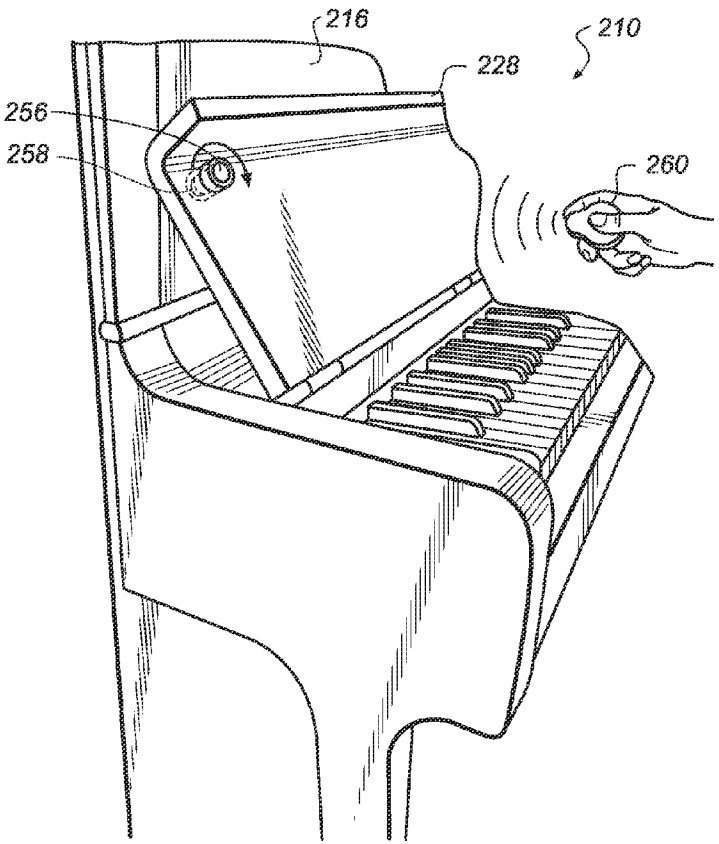
FIGS. 8A and 8B are perspective views of a fallboard retaining system in accordance with another embodiment of the present invention.
Figure 8A:
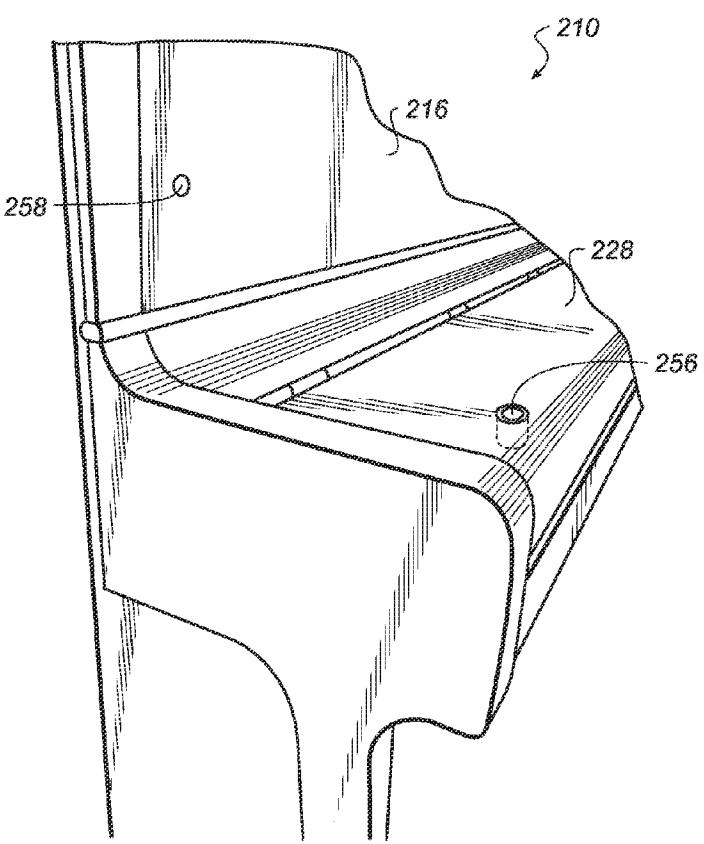

Turning to FIGS. 8A and 8B, a fallboard retainer system 210 includes a permanent magnet 256 coupled to the fallboard 228. In the illustrated embodiment, the permanent magnet 256 is rotatable and embedded in the fallboard 228. A ferromagnetic plate or plug 258 is embedded in the back panel 216, aligned with the magnet 256 when the fallboard 228 is in the upright position (FIG. 8B). The ferromagnetic plate or plug 258 may be another permanent magnet, for example, or a magnetized plate. The magnet 256 is movable to a first position and a second position. In the first position, the magnetic pole of magnet 256 interacts with the ferromagnetic plug 258 such that a magnetic field of the permanent magnet 256 attracts the ferromagnetic material and holds the fallboard 228 against the back panel 216. In the second position, which in one example is rotated 90° from the first position, the magnetic pole of magnet 256 does not interact with the ferromagnetic plug 258, and the fallboard 228 is allowed to freely separate from the back panel 216. The permanent magnet 256 can be adapted to fit within a push-button mechanism, for example, that would move the magnet from the first position to the second position, or vice versa. The push-button mechanism could rotate the magnetic field of the permanent magnet 256 90° or move the magnet in and out of plane with respect to the ferromagnetic plug 258, thereby decreasing the magnetic attraction.

In some embodiments, more than one permanent magnet 256 may be embedded in the fallboard 228. For example, two (or three) permanent magnets may be sufficiently spaced apart to require both hands of the user to rotate the magnets. This arrangement provides a measure of safety to assure one of the user's hands is not on the keyboard 220 when the fallboard 228 is released from the magnetic grip.

In some embodiments, a detached device such as a fob 260 may be adapted to alter the magnetic field of the permanent magnet 256 and thus allow the fallboard 228 to be secured in the upright position or released for lowering. In one example, the fob 260 moves the magnet 256 from a first position of magnetic attraction to a second position of non-magnetic attraction (or magnetic repulsion), or vice versa. In another example, the fob 260 is a key and the key moves the magnet 256 from the first position to the second position, or vice versa. Because the fob 260 is detached and not an integral component of the fallboard retainer system 210, it may be placed in a secure location to prevent other users from lowering the fallboard 228, or it may be carried by the piano owner. In one example, the fob 260 causes the permanent magnet 256 to move or rotate from the first position to the second position, or vice versa. In another example, the fob 260 overcomes the magnetic forces holding the fallboard 228 to the back panel 216.

In other embodiments which are not illustrated, the arrangement of the permanent magnet 256 and ferromagnetic plug 258 may be reversed. That is, the permanent magnet 256 may be embedded in the back panel 216 and the plug 258 may be embedded in the fallboard 228.

Some pianos include knobs on the fallboard to allow a user an easier means of lifting and lowering the fallboard. In this respect, the permanent magnet of the disclosed fallboard retaining system may be embedded within the lifting knob, and further may be rotatable to engage and disengage the magnetic field with the ferromagnetic plug in the back panel.

A piano fallboard may weigh up to 10 pounds (4.5 kg), requiring several strong magnets to hold the fallboard in place. However, very powerful permanent magnets are gaining acceptance in the marketplace and may be economically feasible to incorporate into the disclosed fallboard retainer system. By way of non-limiting example, the permanent magnet 256 may be formed of a neodymium material (e.g., neodymium-iron-boron). One exemplary neodymium permanent magnet that is suitable for use in the disclosed fallboard retaining system is ¾" in diameter and ⅜" thick (19 mm dia×9.5 mm thick), and has a pull force value of over 20 pounds (9.1 kg).

Figure 9B:
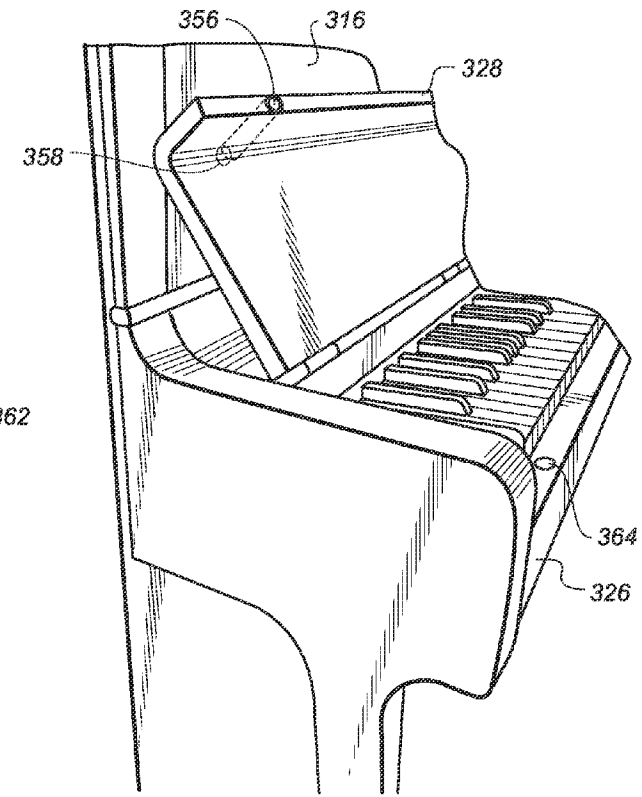
FIGS. 9A and 9B are perspective views of a fallboard retaining device in accordance with another embodiment of the present invention wherein the system further includes a fallboard locking mechanism.
Figure 9A:
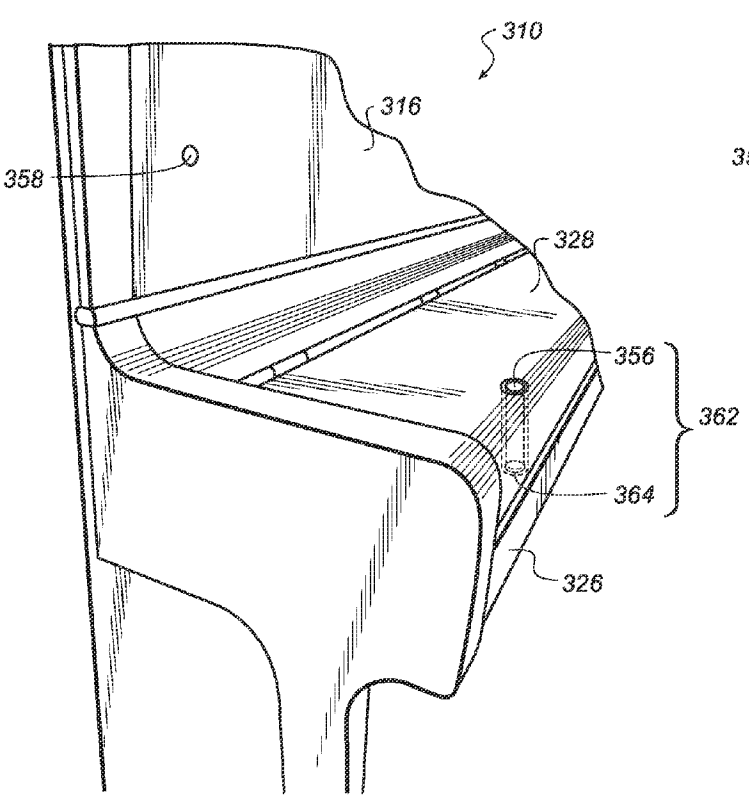

Turning now to FIGS. 9A and 9B, in another embodiment of the present invention, a fallboard retainer system 310 further includes a keyboard lock 362 to prevent the fallboard 328 from being lifted while not in use. Locking the keyboard is particularly important to concert pianists who travel with their piano and wish to prevent unauthorized access to the keyboard. Current commercially-available locking mechanisms are bulky, unsightly, and interfere with the aesthetic beauty of a piano. The disclosed keyboard lock 362 overcomes these disadvantages. In one embodiment, the keyboard lock 362 includes a permanent magnet 356 coupled to the fallboard 328. In the illustrated embodiment, the permanent magnet 356 is rotatable and embedded in the fallboard 328. A ferromagnetic plug 364 is embedded in the piano keyslip 326. The magnet 356 is movable to a first position and a second position. In the first position, the magnetic pole of magnet 356 interacts with the ferromagnetic plug 364 such that a magnetic field of the permanent magnet 356 attracts the ferromagnetic material and holds the fallboard 328 against the keyslip 326. In the second position, which in one example is rotated 90° from the first position, the magnetic pole of magnet 356 does not interact with the ferromagnetic plug 364, and the fallboard 328 is allowed to freely separate from the keyslip 326 and lift to the upright position.

In one embodiment, the piano owner may wish to use the permanent magnet 356 and the ferromagnetic plug 364 solely for securing or locking the fallboard 328, and not necessarily for securing the fallboard 328 in the upright position. In this manner, the strength of the magnetic field of the permanent magnet 356 can be tailored for the specific purpose to which it is intended to operate. In one example, the magnetic field of the permanent magnet 356 can be weak enough so a user can disengage the fallboard 328 with a firm pull, approximately 5 to 10 pounds (22.2 N to 44.4 N), as may be desired when the magnetic force is a deterrent. In another example, the magnetic field of the permanent magnet 356 can be very strong, approximately 50 to 100 pounds (222.4 N to 444.8 N) or more, enough so a user cannot disengage the fallboard 328 with a firm pull. As noted above, a plurality of permanent magnets 356 in spaced-apart relationship could be utilized to provide a very secure lock.

As noted above, the fob 260 (FIG. 8B) may also be adapted to alter the magnetic field of the permanent magnet 356 and thus allow the fallboard 328 to be secured or locked to the keyslip 326 in a lowered position or released for raising to the upright position. In one example, the fob 260 moves the magnet 356 from a first position of magnetic attraction to a second position of non-magnetic attraction (or magnetic repulsion), or vice versa. In another example, the fob 260 is a key and the key moves the magnet 356 from the first position to the second position, or vice versa. Because the fob 260 is detached and not an integral component of the fallboard retainer system 310, it may be placed in a secure location to prevent other users from lowering the fallboard 328, or it may be carried by the piano owner. In one example, the fob 260 causes the permanent magnet 356 to move or rotate from the first position to the second position, or vice versa. In another example, the fob 260 overcomes the magnetic forces holding the fallboard 328 to the keyslip 326.

In some embodiments of the current invention, the user may desire differing forces to hold the fallboard in the upright position versus the closed and locked position. For example, the user may desire a firm pull to release the fallboard from the upright position, but may also desire extraordinary effort to release the fallboard from the closed position. To this end, the mass of the ferromagnetic plug 358 in the back panel 316 may be less than the mass of the second ferromagnetic plug 364 in the keyslip 326. The magnetic holding force of the permanent magnet 356 will therefore be less in the upright position versus the closed position. In one example, the magnetic field of attraction between the permanent magnet 356 and the second ferromagnetic plug 364 could be more than 20 pounds (89 N), and the magnetic field of attraction between the permanent magnet and the ferromagnetic plug 358 in the back panel 316 could be less than 10 pounds (44.4 N). In another example, the magnetic field of attraction between the permanent magnet 356 and the second ferromagnetic plug 364, or combination of magnets and plugs, could be more than 50 pounds (222 N), which requires extraordinary effort to release.

While the present invention has been described with reference to a number of specific embodiments, it will be understood that the true spirit and scope of the invention should be determined only with respect to claims that can be supported by the present specification. Further, while in numerous cases herein wherein systems and apparatuses and methods are described as having a certain number of elements it will be understood that such systems, apparatuses and methods can be practiced with fewer than the mentioned certain number of elements. Also, while a number of particular embodiments have been described, it will be understood that features and aspects that have been described with reference to each particular embodiment can be used with each remaining particularly described embodiment.

A sample of devices and methods disclosed herein follows:

A fallboard retainer system for a piano, comprising:

a piano housing;

a vertical back panel secured to the piano housing;

opposing cheeks extending from and secured to the piano housing;

a keyboard positioned in a horizontal plane between the opposing cheeks;

a keyslip extending between the opposing cheeks along a frontal portion of the keyboard;

a fallboard to protect the keyboard when the piano is not in use, the fallboard positioned between the opposing cheeks and rotatably coupled to the piano housing, the fallboard being rotatable to an open state in an upright position and rotatable to a closed state in a horizontal position, the fallboard supported by the keyslip in the closed state and the vertical back panel in the open state; and a fallboard retaining device for retaining the fallboard in the upright position, the retaining device having a first leg normal to the plane of the keyboard, a second leg in spaced apart relationship with and substantially parallel to the first leg, and a spanner segment parallel to the plane of the keyboard joining the first leg and the second leg, the first leg having a first contact surface for abutment with a stationary surface of the piano, the second leg having a second contact surface for abutment with a movable surface of the fallboard.

The fallboard retainer system according to paragraph [0057], wherein the first contact surface abuts the back panel.

The fallboard retainer system according to paragraph [0058], wherein the first contact surface is in opposing relation to the second contact surface.

The fallboard retainer system according to paragraph [0059], wherein the spanner segment is adapted to separate the first contact surface and the second contact surface by a distance D sufficient to permit the first leg and the second leg to capture and retain the back panel and the fallboard.

The fallboard retainer system according to paragraph [0060], wherein the second leg is adjustable with respect to the first leg.

The fallboard retainer system according to paragraph [0061], wherein the spanner segment of the fallboard retaining device defines an elongated slot, the second leg includes a post extending through the slot, and the fallboard retaining device further comprises a securement element removably coupled to the post.

The fallboard retainer system according to paragraph [0062], wherein the post is threaded, and the securement element is a nut.

The fallboard retainer system according to paragraph [0057], wherein the first contact surface abuts the one of the opposing cheeks.

The fallboard retainer system according to paragraph [0064], wherein at least one of the first leg and the second leg define a bore, and the fallboard retaining device further comprises a securement element extending through the bore.

The fallboard retainer system according to paragraph [0065], wherein the securement element is a screw.

A fallboard retaining device for retaining a piano fallboard in the upright position, comprising:

a first leg having a first contact surface for abutment with a piano back panel;

a second leg in spaced apart relationship with and substantially parallel to the first leg, the second leg having a second contact surface opposing the first contact surface, the second contact surface for abutment with the fallboard; and a spanner segment parallel to the plane of the keyboard joining the first leg and the second leg, the spanner segment is adapted to separate the first contact surface and the second contact surface by a distance D sufficient to permit the first leg and the second leg to capture and retain the back panel and the fallboard.

The fallboard retaining device of paragraph [0067], wherein the second leg is adjustable with respect to the first leg.

The fallboard retaining device of paragraph [0068], wherein the spanner segment of the fallboard retaining device defines an elongated slot, the second leg includes a post extending through the slot, and the fallboard retaining device further comprises a securement element removably coupled to the post.

The fallboard retaining device of paragraph [0069], wherein the post is threaded, and the securement element is a nut.

A fallboard retainer system for a piano, comprising:

a piano housing;

opposing cheeks extending from and secured to the piano housing;

a keyboard positioned in a horizontal plane between the opposing cheeks;

a keyslip extending between the opposing cheeks along a frontal portion of the keyboard, the keyslip having a ferromagnetic plug coupled thereto;

a fallboard to protect the keyboard when the piano is not in use, the fallboard positioned between the opposing cheeks and rotatably coupled to the piano housing, the fallboard being rotatable to an open state in an upright position and rotatable to a closed state in a horizontal position, the fallboard supported by the keyslip in the closed state; and a fallboard retaining device for retaining the fallboard in the closed state in the horizontal position, the retaining device comprising a permanent magnet coupled to the fallboard, the magnet movable to a first position in which a magnetic field of the magnet attracts the ferromagnetic plug and holds the fallboard against the keyslip, the magnet movable to a second position in which in which the magnetic field of the magnet does not attract the ferromagnetic plug and the fallboard is allowed to freely separate from the keyslip.

The fallboard retainer system of paragraph [0071], wherein the first position is rotated 90 degrees from the second position.

The fallboard retainer system of paragraph [0071], further comprising a detached device adapted to alter the magnetic field of the permanent magnet.

The fallboard retainer system of paragraph [0073], wherein the detached device is a fob.

The fallboard retainer system of paragraph [0073], wherein the detached device is a key.

What is claimed is:

1. A method of retaining a piano fallboard in the upright position, the method comprising the steps of:

providing a piano comprising a vertical back panel, a keyboard, a keyslip supporting the keyboard, and a fallboard to protect the keyboard when the piano is not in use; and when the fallboard is in an upright position, releaseably securing the fallboard to the back panel with a fallboard retaining device coupled to one of a planar section of the fallboard and a lip of the fallboard.

2. The method of claim 1, wherein the fallboard retaining device is coupled to the lip of the fallboard.

3. The method of claim 2, wherein the fallboard retaining device comprises:

a first leg having a first contact surface for abutment with the back panel;

a second leg in spaced apart relationship with and substantially parallel to the first leg, the second leg having a second contact surface opposing the first contact surface, the second contact surface for abutment with the fallboard; and a spanner segment parallel to the plane of the keyboard joining the first leg and the second leg, the spanner segment is adapted to separate the first contact surface and the second contact surface by a distance D sufficient to permit the first leg and the second leg to capture and retain the back panel and the fallboard.

4. The method of claim 1, wherein the fallboard retaining device is coupled to the planar section of the fallboard.

5. The method of claim 4, wherein the fallboard retaining device comprises a first permanent magnet and a ferromagnetic material, the step of releasably securing the fallboard to the back panel comprises lifting the fallboard within close proximity to the back panel such that a magnetic field of the first permanent magnet attracts and holds the ferromagnetic material.

6. The method of claim 5, wherein the first permanent magnet is formed of a neodymium material.

7. The method of claim 5, wherein the first permanent magnet is coupled to the back panel and the ferromagnetic material is coupled to the fallboard.

8. The method of claim 7, wherein the step of releasably securing the fallboard to the back panel comprises embedding the first permanent magnet into the back panel and embedding the ferromagnetic material into the fallboard.

9. The method of claim 7, further comprising the step of releasing the fallboard from the back panel by placing a second permanent magnet in proximity to the ferromagnetic material, the second permanent magnet having a greater magnetic field than the first permanent magnet.

10. The method of claim 9, wherein the second permanent magnet is formed of a neodymium material.

11. The method of claim 5, further comprising the step of securing the fallboard to the keyslip when the fallboard is in a closed position.

12. The method of claim 11, wherein the step of securing the fallboard to the keyslip comprises embedding a second ferromagnetic material into the keyslip, embedding the permanent magnet into the fallboard, and lowering the fallboard within close proximity to the keyslip such that a magnetic field of the permanent magnet attracts and holds the second ferromagnetic material.

13. A method of retaining a piano fallboard in a closed position, comprising the steps of:

providing a piano comprising a vertical back panel, a keyboard, a keyslip supporting the keyboard, and a fallboard to protect the keyboard when the piano is not in use; and releaseably securing the fallboard to the keyslip with a fallboard retaining device comprising a first permanent magnet and a ferromagnetic material, the step of releasably securing the fallboard to the keyslip comprising lowering the fallboard within close proximity to the keyslip such that a magnetic field of the first permanent magnet attracts and holds the ferromagnetic material.

14. The method of claim 13, wherein the first permanent magnet is coupled to the fallboard and the ferromagnetic material is coupled to the keyslip.

15. The method of claim 13, wherein the first permanent magnet comprises a plurality of magnets in spaced-apart relationship.

16. A fallboard retainer system for a piano, comprising:

a piano housing;

a vertical back panel secured to the piano housing, the back panel having a ferromagnetic plug coupled thereto;

opposing cheeks extending from and secured to the piano housing;

a keyboard positioned in a horizontal plane between the opposing cheeks;

a keyslip extending between the opposing cheeks along a frontal portion of the keyboard;

a fallboard to protect the keyboard when the piano is not in use, the fallboard positioned between the opposing cheeks and rotatably coupled to the piano housing, the fallboard being rotatable to an open state in an upright position and rotatable to a closed state in a horizontal position, the fallboard supported by the keyslip in the closed state and the vertical back panel in the open state; and a fallboard retaining device for retaining the fallboard in the upright position, the retaining device comprising a permanent magnet coupled to the fallboard, the magnet movable to a first position in which a magnetic field of the magnet attracts the ferromagnetic plug and holds the fallboard against the back panel, the magnet movable to a second position in which in which the magnetic field of the magnet does not attract the ferromagnetic plug and the fallboard is allowed to freely separate from the back panel.

17. The fallboard retainer system of claim 16, wherein the first position is rotated 90 degrees from the second position.

18. The fallboard retainer system of claim 16, further comprising a second ferromagnetic plug coupled to the keyslip, the permanent magnet and the second ferromagnetic plug coupled to form a keyboard lock, wherein the first position of the permanent magnet aligns the magnetic field of the permanent magnet to attract the second ferromagnetic plug and secures the fallboard against the keyslip, and wherein in the second position the magnetic field of the magnet does not attract the second ferromagnetic plug and the fallboard is allowed to freely separate from the keyslip.

19. The fallboard retainer system of claim 18, wherein the magnetic field of attraction between the permanent magnet and the second ferromagnetic plug is stronger than the magnetic field of attraction between the permanent magnet and the first ferromagnetic plug.

20. The fallboard retainer system of claim 19, wherein the magnetic field of attraction between the permanent magnet and the second ferromagnetic plug is more than 89 newtons, and the magnetic field of attraction between the permanent magnet and the ferromagnetic plug in the back panel is less than 44 newtons.

21. The fallboard retainer system of claim 16, further comprising a plurality of permanent magnets coupled to the fallboard.

22. The fallboard retainer system of claim 21, wherein the plurality of permanent magnets are sufficiently spaced apart to require both hands of a user to move the magnets from the first position to the second position.

23. The fallboard retainer system of claim 16, further comprising a detached device adapted to alter the magnetic field of the permanent magnet.

24. The fallboard retainer system of claim 23, wherein the detached device is a fob.

25. The fallboard retainer system of claim 23, wherein the detached device is a key.

26. The fallboard retainer system of claim 23, wherein the magnetic field of the permanent magnet is altered by rotating the magnet.

27. The fallboard retainer system of claim 23, wherein the magnetic field of the permanent magnet is altered by overcoming the magnetic forces holding the fallboard to the back panel.

* * * * *

UNITED STATES PATENT AND TRADEMARK OFFICE

CERTIFICATE OF CORRECTION

PATENT NO. : 8,476,511 B1
APPLICATION NO. : 13/353789
DATED : July 2, 2013
INVENTOR(S) : Marlene Stenuf It is certified that error appears in the above-identified patent and that said Letters Patent is hereby corrected as shown below:

In the Claims

Column 12, claim 16, line 17, delete the words "in which in which" and replace with --in which--

Signed and Sealed this
Fifth Day of November, 2013

Teresa Stanek Rea
*Deputy Director of the United States Patent and Trademark Office*